US007589607B2

(12) United States Patent
Rochon et al.

(10) Patent No.: US 7,589,607 B2
(45) Date of Patent: Sep. 15, 2009

(54) THIN CONTACTOR

(75) Inventors: Sylvain Rochon, Dole (FR); Aurélien Carvalho, La Vieille Loye (FR)

(73) Assignee: CoActive Technologies, Inc, Newton, MA (US)

( * ) Notice: Subject to any disclaimer, the term of this patent is extended or adjusted under 35 U.S.C. 154(b) by 240 days.

(21) Appl. No.: 11/346,920

(22) Filed: Feb. 3, 2006

(65) Prior Publication Data

US 2006/0125580 A1 Jun. 15, 2006

(51) Int. Cl.
*H01H 9/00* (2006.01)
*H01H 1/10* (2006.01)

(52) U.S. Cl. ..... 335/205; 200/514

(58) Field of Classification Search ..... 200/514, 200/516; 335/78, 205–207
See application file for complete search history.

(56) References Cited

U.S. PATENT DOCUMENTS 4,241,246 A 12/1980 Lugaresi
4,365,408 A 12/1982 Ditzig
4,695,681 A 9/1987 Velleman
4,794,215 A 12/1988 Sawada et al.
5,214,256 A 5/1993 Ipcinski
5,828,016 A 10/1998 Grannan et al.
6,730,869 B2 * 5/2004 Teruyama et al. ..... 200/516

FOREIGN PATENT DOCUMENTS

DE 35 13 360 10/1986
EP 0 751 542 2/1997
EP 0 936 852 8/1999
JP 09027244 A * 1/1997

* cited by examiner

*Primary Examiner*—Elvin G Enad
*Assistant Examiner*—Bernard Rojas
(74) *Attorney, Agent, or Firm*—Pepper Hamilton LLP

(57) ABSTRACT

The contactor comprises a fixed contact plate (14), a moveable contact plate (16) and means for retaining the two contact plates (14, 16). The moveable contact plate (16) is resiliently deformable between a position remote from the fixed contact plate (14) and a position in contact with the fixed contact plate (14). The retaining means comprise an adhesive insulating sheet (18) which is interposed between the two contact plates (14, 16), which sheet (18) adheres along the two opposing faces thereof to each of the two contact plates (14, 16).

15 Claims, 2 Drawing Sheets

THIN CONTACTOR

The present invention relates to a contactor, of the type comprising a fixed contact plate, a moveable contact plate and means for retaining the two contact plates, which moveable contact plate is resiliently deformable between a position remote from the fixed contact plate and a position in contact with the fixed contact plate.

A number of miniature electronic devices require contactors of reduced size. These contactors allow an electrical circuit to be opened or closed when they are activated, and can return to the previous state thereof when they are released.

For specific applications, the contactors must have a thickness which is as small as possible.

It has been proposed that contactors be produced in which the two contact plates are retained by a casing which is overmoulded and which is produced by plastics material being injected between and around the two plates.

This solution is relatively difficult to implement.

The object of the invention is to provide a very thin contactor which can be produced in a straightforward manner.

To this end, the invention relates to a contactor of the above-mentioned type, characterised in that the retaining means comprise an adhesive insulating sheet which is interposed between the two contact plates, which adhesive insulating sheet adheres to each of the two contact plates along the two opposing faces thereof.

According to particular embodiments, the contactor comprises one or more of the following features:

- the adhesive insulating sheet is the only means which ensures that the two contact plates are retained;
- the adhesive insulating sheet forms a frame which has a closed contour and which delimits a passage for the moveable contact plate in a contact position;
- the two contact plates and the adhesive insulating sheet have, at the periphery thereof, contours which are substantially identical;
- the adhesive insulating sheet has a thickness of between 50 microns and 150 microns;
- the adhesive insulating sheet comprises an insulating support film which is covered on each face with a layer of an adhesive;
- it comprises a conductive cover which is formed by a metal plate which covers one of the contact plates, and an adhesive insulating sheet is interposed between the conductive cover and the covered contact plate, which adhesive insulating sheet adheres to the contact plate and the conductive cover along the two opposing faces thereof;
- the moveable contact plate comprises a resiliently deformable contact region and a connection region, the moveable contact plate being fixedly joined to the adhesive insulating sheet by means of the connection region; and
- the adhesive insulating sheet is thermally activated.

The invention also relates to a method for producing a contactor of the type described above, characterised in that it comprises the following steps:

- stacking a fixed contact plate and a moveable contact plate, a thermally activatable adhesive insulating sheet being interposed therebetween; and
- heating the stack formed in this manner in order to ensure that the adhesive insulating sheet is activated and to fixedly join the two contact plates.

The invention will be better understood from a reading of the following description, given purely by way of example and with reference to the drawings, in which.

The contactor 10 illustrated in the Figures is intended to be fixedly joined and connected to a printed circuit by means of welding.

The contactor 10 comprises four connection terminals 12A, 12B, 12C and 12D. The terminals 12B and 12D ensure that a protection housing for the contactor is linked, whilst the terminals 12A, 12C define between them a contact which can be opened or closed in accordance with the state of the contactor.

Figure 2:
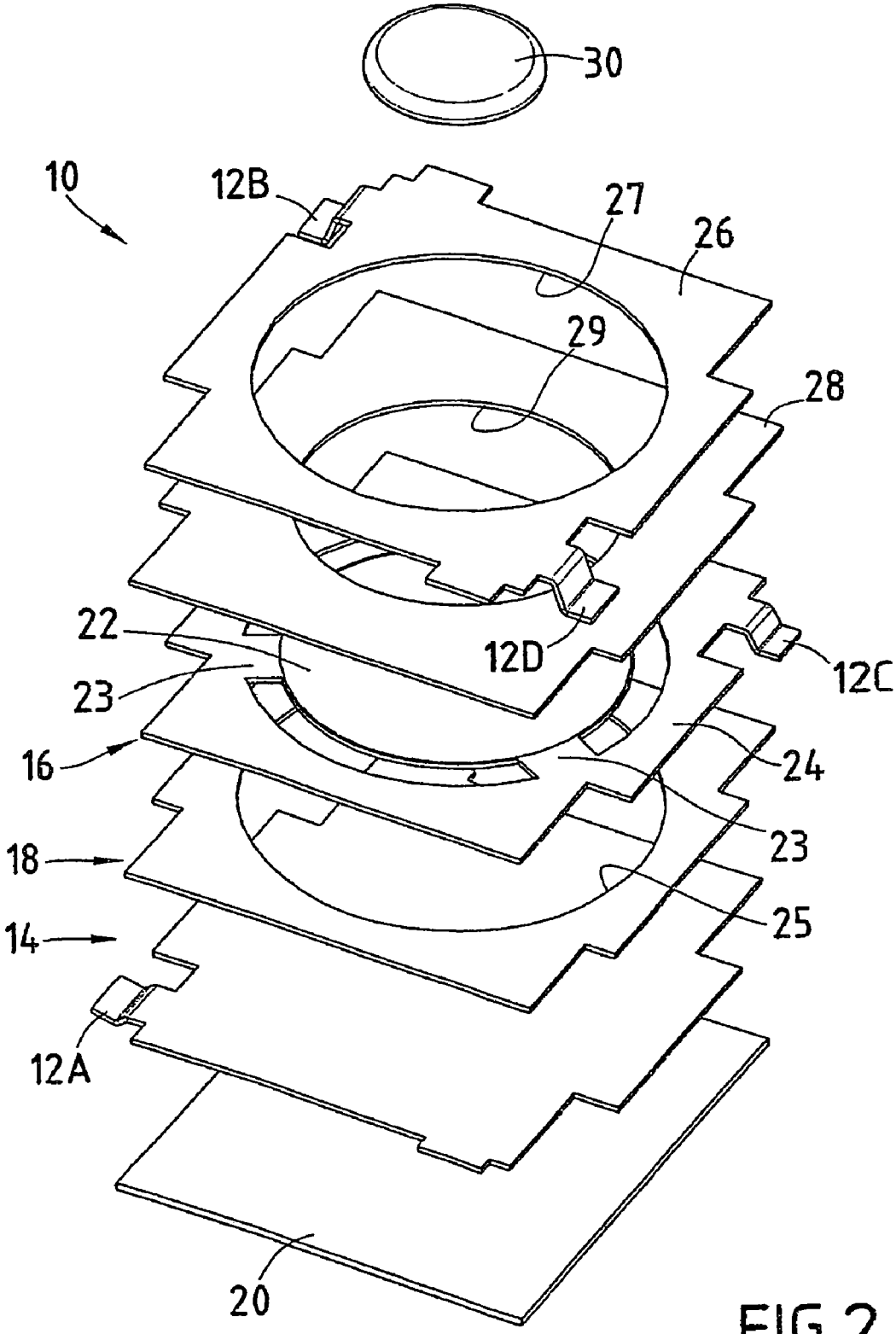
FIG. 2 is an isometric perspective view of the contactor of FIG. 1.

More precisely, and as illustrated in FIG. 2, the contactor substantially comprises a fixed contact plate 14 and a moveable contact plate 16, between which an adhesive insulating sheet 18 is interposed which forms a spacer and which ensures that the two contact plates 14, 16 are linked.

The plates 14, 16 are formed into metal sheets having a constant thickness. This thickness is, for example, equal to 50 microns. It is preferably between 40 and 70 microns. These plates are formed from stainless steel. In one variant, the fixed contact plate 14 is formed from brass.

The fixed contact plate 14 is of a generally square form. This plate is completely flat with the exception of a tab which is shaped towards the outer side and which forms the connection terminal 12A. The plate 14 forms a solid wall and has no openings on the surface thereof.

An insulating sheet 20 is advantageously arranged on the surface of the fixed contact plate 14 at the opposite side to the moveable contact plate 16. It is bonded by any suitable means. The insulating sheet 20 allows electrical contact to be prevented between the fixed contact plate 14 and the tracks of the printed circuit when the contactor is installed on the printed circuit.

Figure 1:
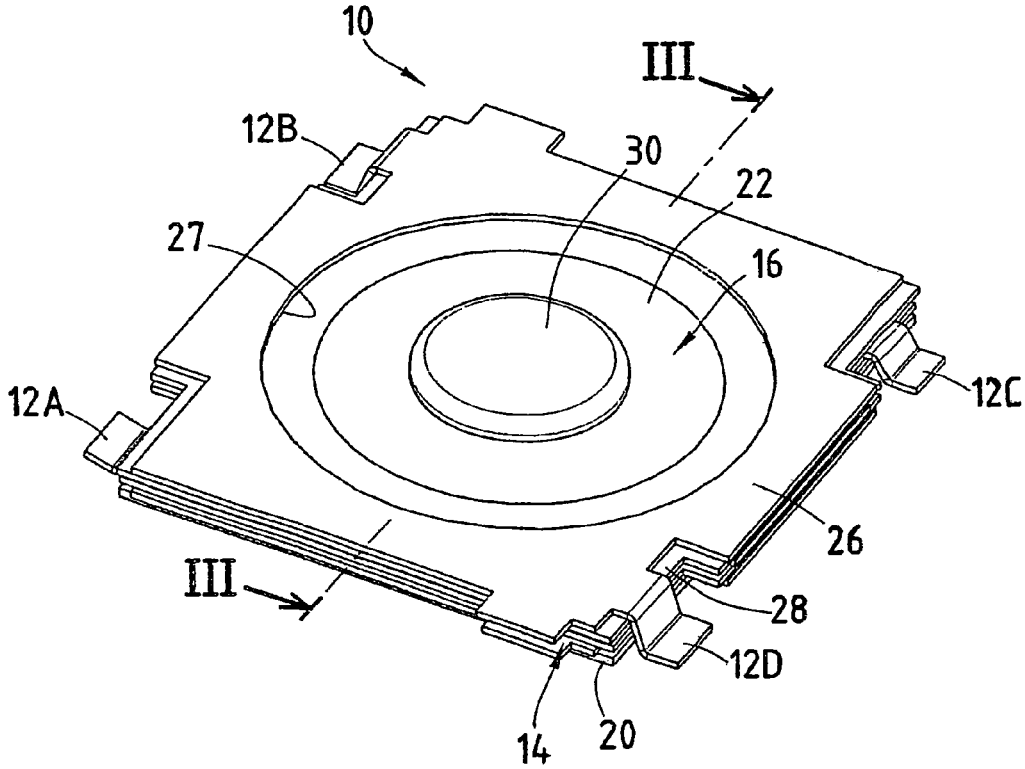
FIG. 1 is an isometric perspective view of the contactor according to the invention.
Figure 3:
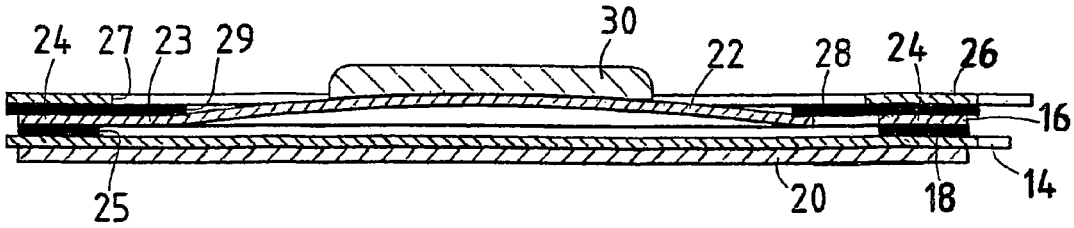
FIG. 3 is a cross-section of the contactor according to the invention, taken along line III-III of FIG. 1.

The moveable contact plate 16 is of a generally square form externally. It has a contour which is substantially identical to that of the fixed contact plate 14. It has, in a corner opposite that where the terminal 12A is formed, a shaped tab which forms the terminal 12C. In the central portion thereof, the moveable contact plate 16 has, as illustrated in FIG. 3, a resiliently deformable bell-like member 22. This bell-like member is rounded and generally protrudes at the opposite side to the fixed contact plate 14. The bell-like member 22 is generally hemispherical. It is bordered at its periphery by three arcuate apertures and is connected to the peripheral portion of the moveable contact plate 16 by means of three flat connection tabs 23. The peripheral portion of the contact plate forms a frame 24 along which the moveable contact plate is fixedly joined to the fixed contact plate by means of the adhesive sheet 18.

The adhesive insulating sheet 18 is of a generally square form and has a periphery which has a shape substantially identical to that of the contact plates 14 and 16. This sheet is flat and has a circular central opening 25 which internally forms a circular passage which allows the bell-like member 22 to be deformed in order to be brought into contact with the fixed contact plate 14.

In this manner, the sheet 18 delimits a frame which forms a closed contour whose shape corresponds to that of the frame 24 of the moveable contact plate.

The sheet 18 has a constant thickness of between 50 microns and 150 microns. It preferably comprises an insulating intermediate support film which forms a support core which is constituted, for example, of polyester. This film has a thickness in the order of 30 microns. Each face of the film carries a layer of thermally activatable adhesive having a thickness in the order of 35 microns.

The sheet 18 is interposed between the contact plates 14 and 16. It ensures that there is sufficient spacing between the two plates to ensure that they are electrically insulated and ensures that the two plates are assembled owing to the adhesion thereof.

Furthermore, the contactor comprises a cover or housing 26 which is attached above the assembly of the two contact plates 14 and 16. This housing is formed by a generally flat metal plate which is shaped only in order to form two tabs which constitute the terminals 12B, 12D. The housing has, in the central portion thereof, an aperture 27 which allows the bell-like member 22 to be activated.

An adhesive insulating retaining sheet 28, identical to that of the sheet 18, is interposed between the moveable contact plate 16 and the housing 26. It ensures that the housing 26 is retained and insulated relative to the moveable contact plate 16. The sheet 28 has a central opening 29 for activating the bell-like member 22.

Finally, an actuator 30, formed by a solid insulating disc, is adhesively bonded to the top of the bell-like member 22. This actuator 30 protrudes through the passages delimited through the adhesive sheet 28 and the housing 26.

It will be appreciated that, when the actuator 30 is pressed, the bell-like member 22 resiliently deforms in a direction perpendicular to the plane of the sheet 18 in such a manner that the curvature thereof is reversed and it comes into contact with the fixed contact plate 14. In this manner, an electrical connection is established between the terminals 12A and 12C.

When the actuator 30 is released, and under the resilient action of the bell-like member 22, the bell-like member 22 once more assumes the rounded form thereof as illustrated in the Figures, thus opening a circuit between the terminals 12A and 12C.

It will be appreciated that the use of the adhesive insulating sheet.18 between the two contact plates allows a very thin contactor to be readily produced, the adhesive sheet at the same time ensuring that there is insulation between the two contact plates and that they are spaced apart and retained.

In order to produce a contactor of this type, the film which forms the core of the sheet 18 is first coated on each of the faces thereof with a thermally activatable adhesive. After each of the metal plates and insulating sheets has been precut, a stack is formed as illustrated in FIG. 2, the insulating sheets 18 and 28 being interposed between the contact plates and the housing 26.

The stack which is formed in this manner is then heated, for example, under the action of electrical resistors which are applied to the two opposing faces of the contactor. Under the action of the heat, the thermally activatable adhesive becomes active and ensures a definitive connection between the insulating sheets and the metal plates which are in contact therewith.

When the heating operation is complete, the various layers of the contactor are definitively connected to each other.

Finally, the actuator 30 is positioned by being bonded to the top of the dome 22.

In this manner, it will be appreciated that a contactor of this type can be produced in a straightforward manner.

The invention claimed is:

1. A contactor comprising:

a fixed contact plate;

a moveable contact plate that is resiliently deformable between a position remote from the fixed contact plate and a position in contact with the fixed contact plate; and a first adhesive insulating sheet which is interposed between the two contact plates, which first insulating adhesive sheet adheres along two opposing faces thereof and retains the two contact plates;

a conductive cover comprising a metal plate positioned over the moveable contact plate, and an aperture adapted to allow the moveable contact plate to be deformed; and a second adhesive insulating sheet interposed between the conductive cover and the moveable contact plate, which second adhesive insulating sheet adheres along two opposing faces of the moveable contact plate and the conductive cover; and wherein the moveable contact plate comprises a resiliently deformable contact region and a connection region, the moveable contact plate being fixedly joined to the first adhesive insulating sheet by the connection region.

2. A contactor according to claim 1, wherein the first adhesive insulating sheet is the only means which ensures that the two contact plates are retained.

3. A contactor according to claim 1, wherein the first adhesive insulating sheet which is interposed between the two contact plates forms a frame which has a closed contour and which delimits a passage for the moveable contact plate in a contact position.

4. A contactor according to claim 1, wherein the two contact plates and the first adhesive insulating sheet have, at the periphery thereof, contours which are substantially identical.

5. A contactor according to claim 1, wherein the second adhesive insulating sheet has a thickness of between 50 microns and 150 microns.

6. A contactor according to claim 5, wherein the second adhesive insulating-sheet comprises an insulating support film which is covered on each face with a layer of an adhesive.

7. A contactor according to claim 1, wherein the second adhesive insulating sheet is thermally activated.

8. A method of producing a contactor, the method comprising:

stacking a fixed contact plate, stacking a first thermally activatable adhesive insulating sheet over the fixed contact plate;

stacking a moveable contact plate over the first thermally activatable adhesive insulating sheet;

stacking a second thermally activatable adhesive insulating sheet over the moveable contact plate;

stacking a conductive cover which is formed by a metal plate over the second thermally activatable adhesive insulating sheet, wherein the conductive cover comprises an aperture adapted to allow the moveable contact plate to be deformed; and heating the stack in order to ensure that the adhesive insulating sheets are activated and to fixedly join the contact plates and the conductive cover; and wherein the moveable contact plate comprises a resiliently deformable contact region and a connection region, the moveable contact plate being fixedly joined to the first thermally activatable adhesive insulating sheet by the connection region.

9. A contactor comprising:

a fixed contact plate;

a moveable contact plate that is resiliently deformable between a position remote from the fixed contact plate and a position in contact with the fixed contact plate; and a first insulating sheet which is interposed between the two contact plates, which first insulating adhesive sheet adheres along two opposing faces thereof to ensure that the two contact plates are sufficiently spaced to ensure that they are electrically insulated;

a conductive cover positioned over the moveable contact plate, wherein the conductive cover comprises an aperture adapted to allow the moveable contact plate to be deformed; and a second insulating sheet interposed between the conductive cover and the moveable contact plate, which second insulating sheet adheres along two opposing faces of the moveable contact plate and the conductive cover; and wherein the moveable contact plate comprises a resiliently deformable contact region and a connection region, the moveable contact plate being fixedly joined to the first adhesive insulating sheet by the connection region.

10. A contactor according to claim 9, wherein the first adhesive insulating sheet is the only means which ensures that the two contact plates are retained.

11. A contactor according to claim 9, wherein the first adhesive insulating sheet which is interposed between the two contact plates forms a frame which has a closed contour and which delimits a passage for the moveable contact plate in a contact position.

12. A contactor according to claim 9, wherein the two contact plates and the first adhesive insulating sheet have, at the periphery thereof, contours which are substantially identical.

13. A contactor according to claim 9, wherein the second adhesive insulating sheet has a thickness of between 50 microns and 150 microns.

14. A contactor according to claim 13, wherein the second adhesive insulating-sheet comprises an insulating support film which is covered on each face with a layer of an adhesive.

15. A contactor according to claim 9, wherein the second adhesive insulating sheet is thermally activated.

* * * * *